US009353568B2

(12) United States Patent
Knight et al.

(10) Patent No.: US 9,353,568 B2
(45) Date of Patent: May 31, 2016

(54) METHODS, APPARATUSES, AND SYSTEMS FOR DRIVING A MOVABLE PARTITION

(75) Inventors: Tracy M. Knight, Kearns, UT (US); Michael E. Hazlett, Taylorsville, UT (US)

(73) Assignee: Won-Door Corporation, Salt Lake City, UT (US)

( * ) Notice: Subject to any disclaimer, the term of this patent is extended or adjusted under 35 U.S.C. 154(b) by 823 days.

(21) Appl. No.: 12/542,448

(22) Filed: Aug. 17, 2009

(65) Prior Publication Data

US 2011/0036016 A1 Feb. 17, 2011

(51) Int. Cl.

| | |
|---|---|
| ***E06B 3/94*** | (2006.01) |
| *E05F 15/635* | (2015.01) |
| *E05F 15/643* | (2015.01) |

(52) U.S. Cl.

CPC ..... *E06B 3/94* (2013.01); *E05F 15/635* (2015.01); *E05F 15/643* (2015.01); *E05Y 2201/218* (2013.01); *E05Y 2201/246* (2013.01);

(Continued)

(58) Field of Classification Search

CPC ..... E05F 15/638; E05F 15/635; E05F 15/643; E06B 3/94; E06B 3/481; E05Y 2900/142; E05Y 2600/46; E05Y 2600/10; E05Y 2201/716; E05Y 2201/218; E05Y 2201/246; E05Y 2201/722; E05Y 2201/434; E04B 2/827

USPC ..... 52/174, 234, 236.6, 238.1, 243.1, 64, 52/66; 49/125, 127, 139, 140, 221, 409, 49/412, 417; 160/188, 191, 192, 201, 202, 160/196.1, 206, 209

See application file for complete search history.

(56) References Cited

U.S. PATENT DOCUMENTS

| | | | |
|---|---|---|---|
| 1,817,909 | A | 8/1931 | Blodgett |
| 1,862,860 | A | 6/1932 | Morse |

(Continued)

FOREIGN PATENT DOCUMENTS

| | | | |
|---|---|---|---|
| DE | 20 2005 000 165 | U1 | 3/2006 |
| EP | 1126125 | A2 | 12/2003 |

(Continued)

OTHER PUBLICATIONS

International Search Report of the ISA/KR, International Application No. PCT/US2010/045763, Apr. 22, 2011, three (3) pages.

(Continued)

*Primary Examiner* — Basil Katcheves
*Assistant Examiner* — Theodore Adamos
(74) *Attorney, Agent, or Firm* — TraskBritt

(57) ABSTRACT

Movable partition systems include an elongated, fixed drive member extending along a track, a partition that is automatically and manually movable along the track, and a motor carried by the movable partition configured to drive a rotatable drive member that is engagable with the elongated, fixed drive member. The rotatable drive member may be engaged with, and disengaged from, the fixed drive member. Methods of moving a partition along a track include actuating a motor carried by a movable partition to drive rotation of a drive member while the drive member is engaged with an elongated, fixed drive member, and manually moving the partition along the track while the rotatable drive member is disengaged from the fixed drive member. Methods of installing a movable partition system include configuring a rotatable drive member to be capable of engagement with, and disengagement from, an elongated, fixed drive member.

13 Claims, 8 Drawing Sheets

(52) U.S. Cl.
CPC ..... *E05Y2201/434* (2013.01); *E05Y 2201/462* (2013.01); *E05Y 2201/716* (2013.01); *E05Y 2201/722* (2013.01); *E05Y 2600/10* (2013.01); *E05Y 2600/46* (2013.01)

(56) References Cited

U.S. PATENT DOCUMENTS

| | | | | |
|---|---|---|---|---|
| 2,703,236 | A | 3/1955 | Verdier | |
| 2,879,058 | A | 3/1959 | Phillips | |
| 3,012,520 | A | 12/1961 | Curtis | |
| 3,166,306 | A | 1/1965 | Peltier | |
| 3,240,484 | A | 3/1966 | Klamp | |
| 3,261,128 | A * | 7/1966 | Slopa et al. | 49/98 |
| 3,289,741 | A | 12/1966 | Gossling | |
| 3,336,968 | A | 8/1967 | Curtis | |
| 3,509,934 | A | 5/1970 | Smart | |
| 3,577,679 | A | 5/1971 | Petterborg | |
| 3,720,254 | A | 3/1973 | Smart | |
| 3,799,237 | A * | 3/1974 | Proserpi | E06B 3/481 160/199 |
| 3,807,480 | A | 4/1974 | Smart | |
| 3,909,980 | A * | 10/1975 | Courtney et al. | 49/199 |
| 4,133,364 | A | 1/1979 | Smart | |
| 4,167,833 | A | 9/1979 | Farina et al. | |
| 4,957,600 | A | 9/1990 | Carlson et al. | |
| 5,253,451 | A * | 10/1993 | Hormann | 49/139 |
| 5,625,266 | A | 4/1997 | Stark | |
| 5,794,381 | A * | 8/1998 | Rizkovsky | 49/139 |
| 6,082,053 | A * | 7/2000 | Bischof et al. | 52/64 |
| 6,209,171 | B1 * | 4/2001 | Pelletier et al. | 16/97 |
| 6,233,878 | B1 * | 5/2001 | Krahenbuhl et al. | 52/64 |
| 6,325,134 | B1 * | 12/2001 | Mullet | 160/189 |
| 6,615,894 | B1 | 9/2003 | McKeon | |
| 6,662,848 | B2 | 12/2003 | Goodman et al. | |
| 7,114,753 | B2 * | 10/2006 | Nodorft | 292/137 |
| 7,478,663 | B2 | 1/2009 | Goodman et al. | |
| 7,481,133 | B2 * | 1/2009 | Walravens et al. | 74/625 |
| 7,513,293 | B2 | 4/2009 | Goodman et al. | |
| 2007/0095488 | A1 | 5/2007 | Huang | |
| 2008/0244991 | A1 | 10/2008 | Coleman et al. | |
| 2009/0160297 | A1 * | 6/2009 | Anikhindi et al. | 312/319.7 |
| 2009/0188633 | A1 | 7/2009 | Goodman et al. | |

FOREIGN PATENT DOCUMENTS

| | | | |
|---|---|---|---|
| JP | 2002-357055 | A | 12/2002 |
| WO | 03071078 | A1 | 8/2003 |
| WO | 2005/098189 | A1 | 10/2005 |
| WO | 2005124082 | A1 | 12/2005 |
| WO | 2007/105057 | A2 | 9/2007 |
| WO | 2008086519 | A2 | 7/2008 |

OTHER PUBLICATIONS

Written Opinion of the International Searching Authority, International Application No. PCT/US2010/045763, Apr. 22, 2011, three (3) pages.

U.S. Appl. No. 07/215,413, filed Jul. 5, 1988, entitled "Motorized Folding Door Lead Post Assembly and Apparatus for Monitoring Door Position", abandoned.

Goodman et al., U.S. Appl. No. 07/215,413, filed Jul. 5, 1988, entitled "Motorized Folding Door Lead Post Assembly and Apparatus for Monitoring Door Position", abandoned.

* cited by examiner

METHODS, APPARATUSES, AND SYSTEMS FOR DRIVING A MOVABLE PARTITION

CROSS-REFERENCES TO RELATED APPLICATION

The subject matter of the present application is related to subject matter of U.S. patent application Ser. No. 12/758,584, which was filed Apr. 12, 2010, now U.S. Pat. No. 8,365,796, issued Feb. 5, 2013.

TECHNICAL FIELD

Embodiments of the present invention are directed to the field of movable partitions used for partitioning space, as sound barriers, as fire barriers, security barriers, and for various other applications.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event such as the actuation of an associated alarm. For example, one or more accordion or similar folding-type partitions may be used as a security barrier, a fire barrier, or both a security barrier and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along an overhead track, which is often located above the movable partition in a header assembly, until the partition extends a desired distance across the room.

When deployed, a leading end of the movable partition, often defined by a component known as a lead post, complementarily engages a another structure, such as a wall, a post, or a lead post of another door.

Automatic extension and retraction of the movable partition may be accomplished through the use of a motor located in a pocket formed in the wall of a building in which the movable partition is stored when in a retracted or folded state. The motor, which remains fixed in place within the pocket, may be used to drive extension and retraction of the movable partition. A motor for automatically extending and retracting a movable partition may also be mounted within the movable partition itself, such that the motor travels with the movable partition as the movable partition is extended and retracted using the motor.

BRIEF SUMMARY

In some embodiments, the present invention includes movable partition systems comprising an elongated, fixed drive member extending along a track, a motor carried by a movable partition having a rotatable drive member coupled to a drive shaft of the motor and engagable with the elongated, fixed drive member. The movable partition is coupled to, and movable along, the track. The rotatable drive member may be movable relative to the elongated, fixed drive member between an engaged position in which the rotatable drive member is engaged with the elongated, fixed drive member, and a disengaged position in which the rotatable drive member is disengaged from the elongated, fixed drive member. Rotation of the rotatable drive member while the rotatable drive member is in the engaged position causes the movable partition to move along the track.

In additional embodiments, the present invention includes automatically and manually movable partition systems that include a movable partition coupled to and movable along a track, and a motor for driving movement of the movable partition along the track. Actuation of the motor drives movement of the movable partition along the track when the motor is actuated and the movable partition is in an engaged configuration. Actuation of the motor does not drive movement of the movable partition along the track when the motor is actuated and the movable partition system is in a disengaged configuration. Furthermore, manual movement of the movable partition may urge the movable partition system to the disengaged configuration.

In additional embodiments, the present invention includes methods of moving a movable partition along a track. In accordance with such methods, a rotatable drive member may be engaged with an elongated, fixed drive member extending along the track, and a motor carried by the movable partition may be actuated and rotation of the rotatable drive member may be driven while the rotatable drive member is engaged with the elongated, fixed drive member. The rotatable drive member may be disengaged from the elongated, fixed drive member, and the movable partition may be manually moved along the track while the rotatable drive member is disengaged from the elongated, fixed drive member.

In yet further embodiments, the present invention includes methods of installing a movable partition system. In accordance with such methods, a movable partition may be movably coupled to a track, and a motor may be mounted to the movable partition. A rotatable drive member may be coupled to a drive shaft of the motor, and the rotatable drive member may be configured to be movable relative to the elongated drive member between an engaged position in which the rotatable drive member is engaged with the elongated drive member and a disengaged position in which the rotatable drive member is disengaged with the elongated drive member.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the description of embodiments of the invention when read in conjunction with the accompanying drawings, in which:

DETAILED DESCRIPTION

Illustrations presented herein are not meant to be actual views of any particular movable partition system, or component of a movable partition system, but are merely idealized representations that are employed to describe embodiments of the present invention. Additionally, elements common between figures may retain the same numerical designation.

Figure 1:
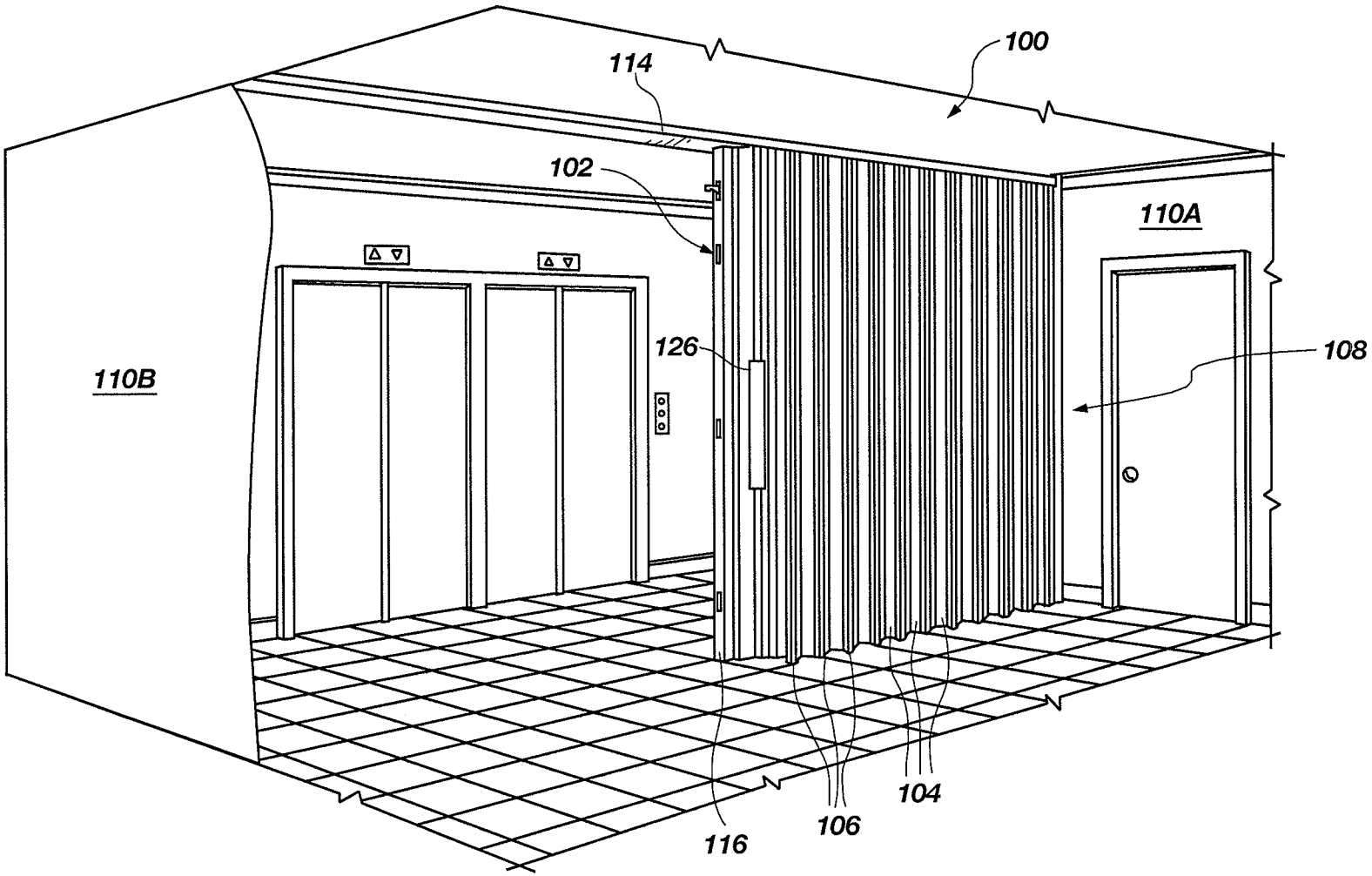
FIG. 1 is a perspective view of an embodiment of a movable partition system of the present invention.

FIG. 1 illustrates an embodiment of a movable partition system 100 of the present invention. The movable partition system 100 is an automatic movable partition system, in that the system 100 includes a movable partition 102 that may be automatically extended, automatically retracted, or both automatically extended and automatically retracted. As discussed in further detail below, the movable partition 102 also may be manually extended, manually retracted, or both manually extended and manually retracted. The movable partition 102 may be used for partitioning space, as a sound barrier, as a fire barrier, as a security barrier, for combinations of such purposes, or for other purposes.

The movable partition 102 may comprise, for example, an accordion-type door, as shown in FIG. 1. The movable partition 102 may be formed with a plurality of panels 104 that are connected to one another with hinges or other hinge-like members 106. The hinged connection of the panels 104 allows the panels 104 to fold, and the movable partition 102 to collapse, as the movable partition 102 is retracted, which allows the movable partition 102 to be compactly stored in a pocket 108 formed in a wall 110A of a building when in a retracted or folded state. In other embodiments, the movable partition 102 may comprise a sliding door, or another type of movable partition 102.

Figure 2:
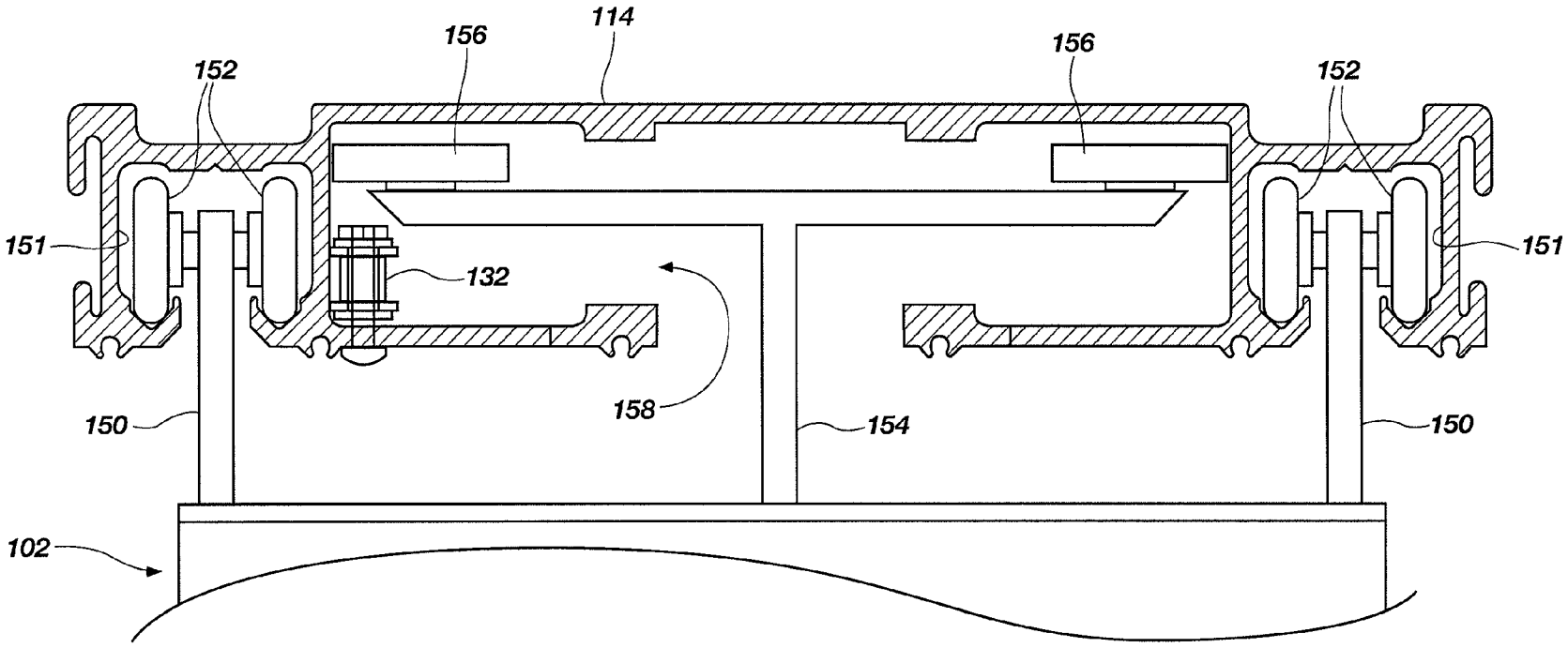
FIG. 2 is a partial cross-sectional view of a support system of the movable partition system of FIG. 1.

When it is desired to deploy the movable partition 102 to an extended position, the movable partition 102 is driven along a track 114 or track assembly across the space to provide an appropriate barrier. As can be seen in FIG. 2, the movable partition 102 may be suspended from (i.e., hang from) partition support members 150 and move along the track 114 by the rolling of partition support wheels 152 within and along wheel channels 151 of the track 114, the partition support wheels 152 being coupled to the partition support members 150 and, hence, the movable partition 102 suspended therefrom. The movable partition system 100 may further include an alignment device for ensuring that the movable partition 102 stays aligned with track 114 as the movable partition 102 is extended or retracted. For example, the alignment device may comprise an alignment frame structure 154 coupled to the movable partition 102. The alignment device may further include alignment wheels 156 configured to roll along the track 114 within a central drive channel 158 extending through the track 114, as shown in FIG. 2. One or more alignment wheels 156 may be configured to roll along a vertical interior lateral wall of the track 114 within the drive channel 158, and one or more alignment wheels 156 may be configured to roll along an opposite vertical interior lateral wall of the track 114 within the drive channel 158. A portion of the alignment frame structure 154 may be disposed outside the drive channel 158, and another portion of the alignment frame structure 154 may be disposed within the drive channel 158, such that the alignment frame structure 154 extends through an opening in the track 114 leading to the drive channel 158.

Figure 3:
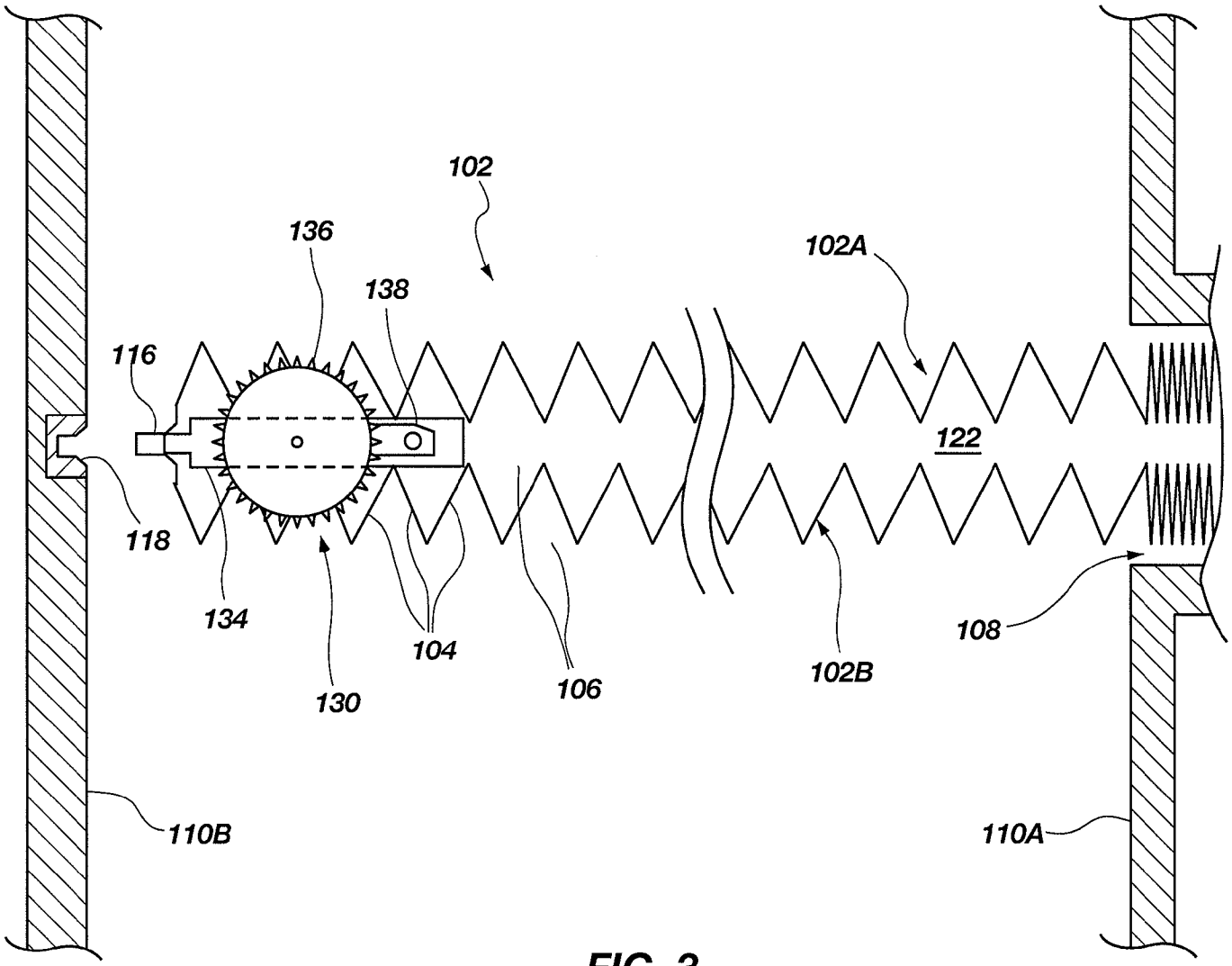
FIG. 3 is a simplified top view illustrating the movable partition and components of a drive system of the movable partition system of FIG. 1.

Referring now to FIG. 3, a leading end of the movable partition 102, shown as a male lead post 116, matingly (i.e., complementarily) engages with a jamb or door post 118 that may be formed in another wall 110B of a building, when the movable partition 102 is in a deployed or an extended state.

An accordion-type movable partition 102 may include a first sheet 102A of panels 104 and a second sheet 102B of panels 104 that is laterally spaced from the first sheet 102A of panels 104. Such a configuration may be used as a fire door wherein the first sheet 102A acts as a primary fire and smoke barrier, the space 122 between the first sheet 102A and the second sheet 102B acts as an insulator or a buffer zone, and the second sheet 102B acts as a secondary fire and smoke barrier. Such a configuration may also be useful in providing an acoustical barrier when the movable partition 102 is used to subdivide a larger space into multiple rooms.

Figure 4:
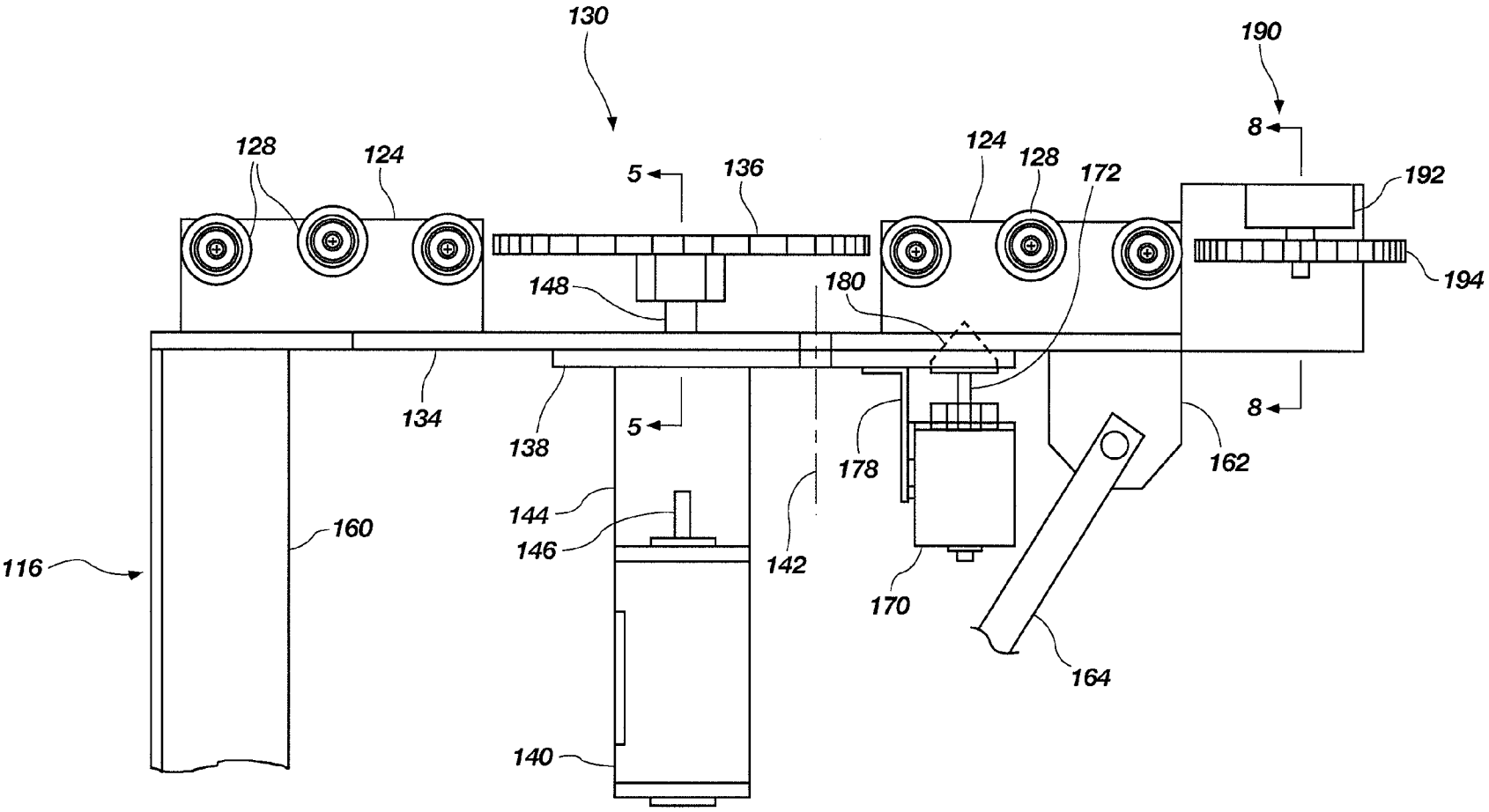
FIG. 4 is a side view illustrating components of the drive system and the support system of the movable partition system of FIG. 1.

Referring to FIG. 4 in conjunction with FIG. 3, an automatic drive mechanism 130 may be configured to automatically open, automatically close, or to both automatically open and automatically close the movable partition 102 upon actuation thereof. The drive mechanism 130 may include a support plate 134, which may be located within the movable partition 102 (between the first sheet 102A and the second sheet 102B) near the leading end of the movable partition 102. The drive mechanism 130 may include a rotatable drive member such as, for example, a rotatable drive member 136, connected to the drive shaft of a motor 140 (FIG. 4), such that the motor 140 may be used to drive rotation of the rotatable drive member 136. As discussed in further detail below, the rotatable drive member 136 may be positioned adjacent the track 114 (FIG. 2) (e.g., within the drive channel 158 of the track 114), and may be configured to interact with an elongated, fixed drive member 132 such as, for example, a fixed chain, also positioned adjacent the track 114.

Figure 5:
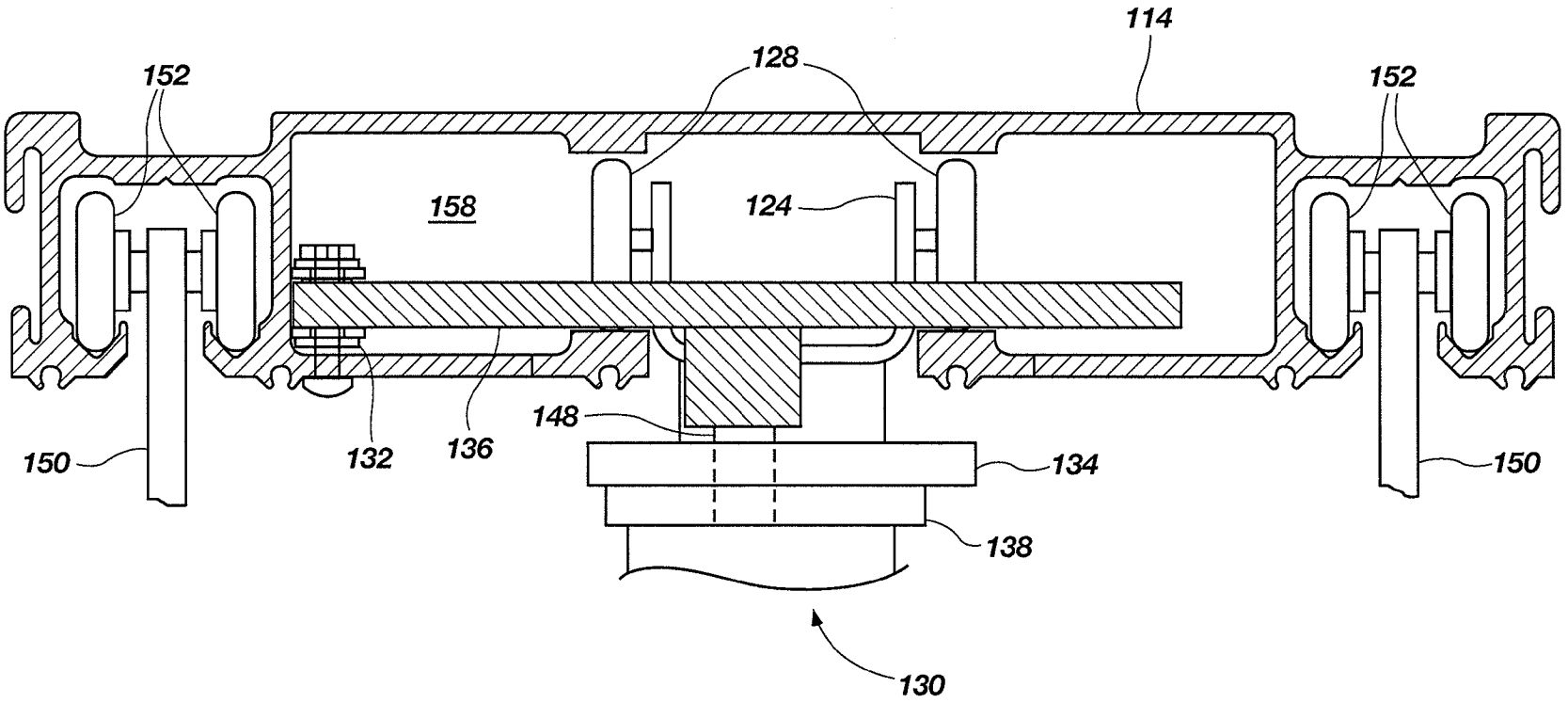
FIG. 5 is a partial cross-sectional view like that of FIG. 2 taken along section line 5-5 in FIG. 4.

As can be seen in FIG. 5 in conjunction with FIG. 4, the drive mechanism 130 may hang from one or more support trolleys 124 and move along the track 114 by the rolling of trolley wheels 128 attached to the support trolleys 124. The support trolley 124 and trolley wheels 128 may be disposed fully or partially within the drive channel 158 in the track 114. The drive rotatable drive member 136 may also be disposed within the drive channel 158 of the track 114. An elongated, fixed drive member 132, which, in some embodiments, may comprise a chain fixed in place, may be disposed within the track 114 so as to be engaged with the rotatable drive member 136 when the drive mechanism 130 is in an engaged state. In this configuration, when the motor 140 drives the rotatable drive member 136 and the rotatable drive member 136 is engaged with the fixed drive member 132, the movable partition 102 is extended or retracted along the track 114. The automatic movable partition system 100 may further include various sensors, switches, and controls to assist in the control of the movable partition 102 through appropriate connection with the drive mechanism 130.

It is noted that, while the embodiment shown and described with respect to FIGS. 1 through 5 above is directed to a single accordion-type movable partition 102, other movable partitions may be used. For example, a two-door, or bi-part door, system may be utilized wherein two similarly configured doors extend across a space and join together to form an appropriate barrier. Also, the present invention is applicable to movable partitions or barriers other than the accordion-type doors that are shown and described herein as an embodiment.

Referring again to FIG. 4, in accordance with one embodiment, a support plate 134 is provided, which is attached to and carried within the movable partition 120. The support plate 134 may be attached near or at the top of the lead post 116. The lead post 116 may further be attached to a lead post attachment bracket 160. A diagonal bar attachment bracket 162 may be attached to the support plate 134. A diagonal bar 164 may be attached to the diagonal bar attachment bracket 162 and to the lead post attachment bracket 160. Thus, the lead post attachment bracket 160, support plate 134, and diagonal bar 164 may form a triangle to structurally support the drive mechanism 130.

As can be seen in FIG. 4, the drive mechanism 130 may include a motor 140 which controls and drives rotation of the rotatable drive member 136, shown in the figures as a sprocket. An optional gearbox 144 may be installed between the motor 140 and the rotatable drive member 136. The gearbox 144 may be desirable for better control or increased power when driving the rotatable drive member 136, for example. In embodiments which use a gearbox 144, the motor 140 may drive a drive shaft 146, which is also the input shaft for the gearbox 144. The gearbox 144 may transfer the power from the motor 140 to a drive shaft 148. The drive shaft 148 may be connected to the rotatable drive member 136 to drive the rotation of the rotatable drive member 136. When the rotatable drive member 136 is engaged with the fixed drive member 132, the rotation of the rotatable drive member 136 causes the movable partition 102 to be pulled or pushed along the track 114 of the automatic movable partition system 100.

In some embodiments, there may be no clutch device installed between the motor 140 and the rotatable drive member 136 for disengaging the rotatable drive member 136 from the motor 140. Thus, the rotatable drive member 136 may be fixedly mounted to the drive shaft 146 of the motor 140. In other words, the rotatable drive member 136 may not be disengaged from the motor 140 in any manner other than disassembly.

In one embodiment, the motor 140 may include a brushed DC motor and the gearbox 144 may include a planetary gearbox, both available from Dunkermotoren-USA of Torrance, Calif. Of course, it will be appreciated by those of ordinary skill in the art that other components may be used for the motor 140 and gearbox 144 in practicing the described embodiment. Additionally, other mechanisms may be used for driving the movable partition 102 along the track 114.

The drive mechanism 130 may not include a gearbox 144 in some embodiments. In such embodiments, the motor 140 drives the drive shaft 148 directly, which is attached to the rotatable drive member 136.

Figure 6A:
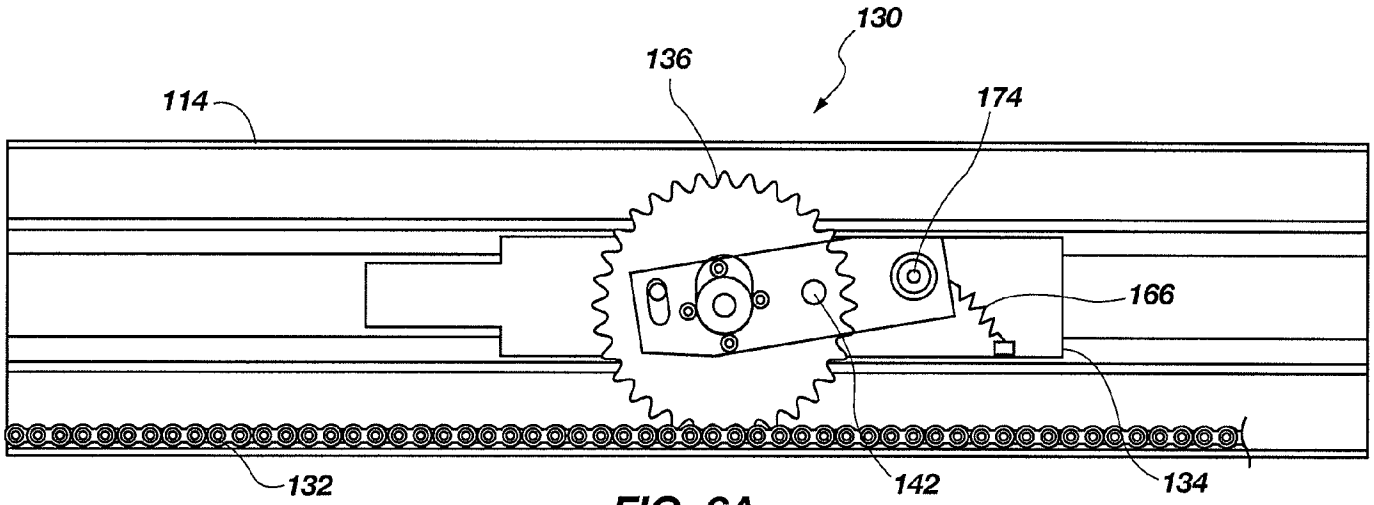
FIGS. 6A and 6B are top plan views illustrating components of the drive system of the movable partition system of FIG. 1 in an engaged state and in a disengaged state, respectively.

Referring to FIG. 6A, the rotatable drive member 136 (e.g., sprocket) may be engaged with the fixed drive member 132 (e.g., fixed chain). When the rotatable drive member 136 is engaged with the fixed drive member 132, the rotation of the rotatable drive member 136 causes the movable partition 102 to be pulled or pushed along the track 114 of the automatic movable partition system 100 into a desired position. In other words, the movable partition system 100 may be in an engaged configuration. FIG. 6A shows the elongated, fixed drive member 132 as a fixed chain that is complementary to the teeth of a sprocket that serves as the rotatable drive member 136. The fixed drive member 132 may be fixed at both longitudinal ends of the track 114, such as in pocket 108 in wall 110A and at the jamb or door post 118 in wall 110B (FIGS. 1 and 3). Fixed drive member 132 may further be secured to track 114 intermittently or continuously along its length for increased stability.

In additional embodiments, the fixed drive member 132 may comprise a rack and the rotatable drive member 136 may comprise a pinion, or the fixed drive member 132 may comprise a belt and the rotatable drive member 136 may comprise a pulley. Any of these configurations or their equivalents may be used to drive the movable partition 102 along the track 114 in accordance with embodiments of the present invention.

Figure 6B:
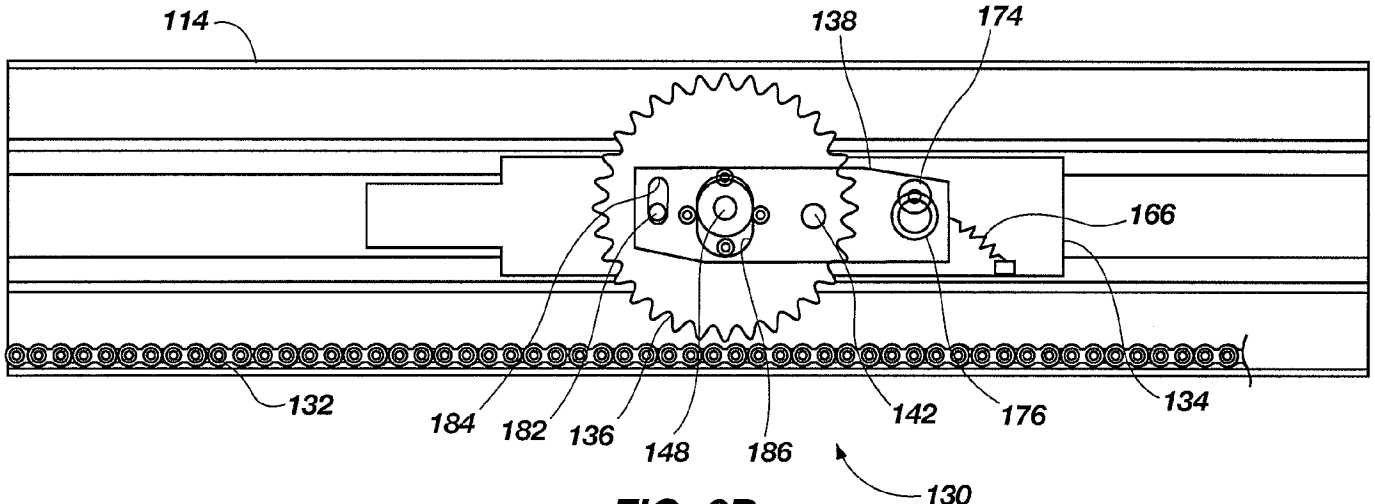

As shown in FIG. 6B, the drive mechanism 130 may be configured to allow the rotatable drive member 136 to be disengaged from the elongated, fixed drive member 132. In other words, the movable partition system 100 may be in a disengaged configuration, as discussed in further detail below.

Figure 7B:
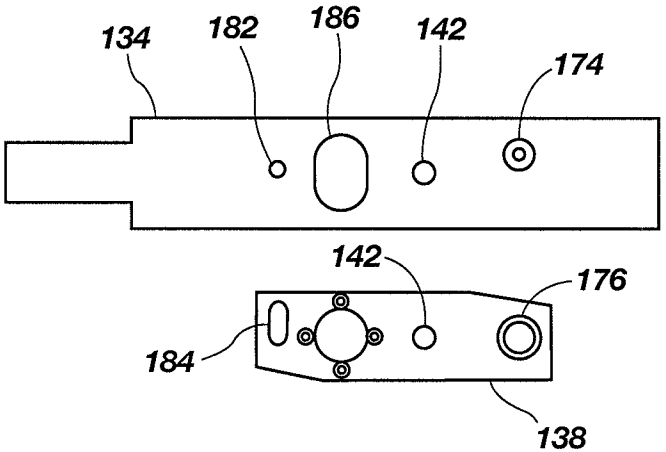
FIGS. 7A and 7B are exploded views illustrating components of the drive system of the movable partition system of FIG. 1 that are used for moving the drive system between the disengaged state and the engaged state.
Figure 7A:
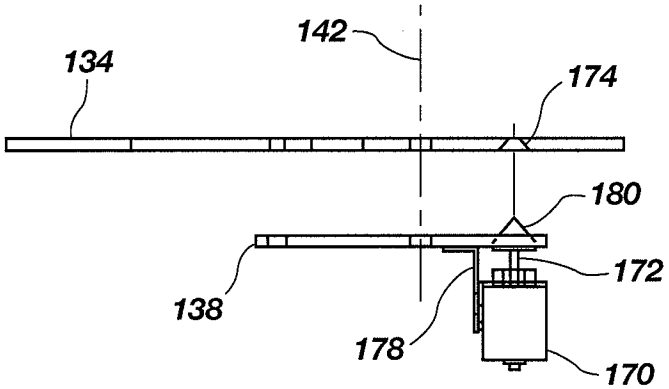

Referring now to FIGS. 7A and 7B, a system for engaging and disengaging the drive mechanism 130 of the movable partition system 100 is disclosed. As previously discussed, a support plate 134 may be rigidly attached to the movable partition 102. A motor mounting plate 138 may be movably (e.g., pivotally) secured to the support plate 134 so as to be enable the motor mounting plate 138 to move (e.g., pivot or rotate) about an axis 142 (FIG. 4) relative to the support plate 134. The drive mechanism 130 may be attached to the motor mounting plate 138 (which is movably attached to the support plate 134). A limit pin 182 may be attached to the support plate 134, and a slot 184 may be formed in the motor mounting plate 138 that is configured to receive the limit pin 182 therein when the motor mounting plate 138 is attached to the support plate 134. The slot 184 formed in the motor mounting plate 138 may have a length that determines the limits of the relative movement between the motor mounting plate 138 and the support plate 134. Thus, when limit pin 182 reaches an end of the mounting plate slot 184, the motor mounting plate 138 is in a desired orientation, causing either engagement of the rotatable drive member 136 with the elongated, fixed drive member 132, as shown in FIG. 6A, or disengagement of the rotatable drive member 136 with the elongated, fixed drive member 132 as shown in FIG. 6B. The support plate 134 may further include a slot 186 therein through which motor 140, gearbox 144, and/or drive shaft 148 extend and may freely travel as motor mounting plate 134 rotates, for example.

As shown in FIGS. 7A and 4, a solenoid support bracket 178 may be attached to the motor mounting plate 138, and an engagement device 170 may be attached to the solenoid support bracket 178. In other embodiments, the engagement device 170 may be an electromechanical solenoid. The engagement device 170 controls the extension and/or retraction of an engagement member 172, which may be a solenoid plunger. A tapered engagement cone 180 may be provided on the engagement member 172. When attached in this configuration, the driving of tapered engagement cone 180 against a surface of at least one of the support plate 134 and the motor mounting plate 138 causes the rotation of the motor mounting plate 138 into a desired orientation relative to support plate 134 causing engagement of the rotatable drive member 136 with the elongated, fixed drive member 132.

Referring now to FIG. 7B, the rotation may be accomplished, for example, by providing a tapered engagement recess 174 in the support plate 134, and an engagement recess 176 extending through the motor mounting plate 138. By way of example and not limitation, the engagement recesses 174 and 176 may be holes, apertures, indentations, cutouts, or any combination of holes, apertures, indentations, or cutouts. The engagement recess 176 extending through the motor mounting plate 138 may be sized and shaped to allow the tapered engagement cone 180 to pass at least partially therethrough, and the tapered engagement recess 174 in the support plate 134 may have a size and shape that is at least substantially complementary to an outer surface of the tapered engagement cone 180.

The tapered engagement recess 174 in the support plate 134 and the engagement recess 176 in the motor mounting plate 138 may be positioned relative to one another in such a manner that the drive mechanism 130 is in an engaged configuration, as shown in FIG. 6A, when the center of the tapered engagement recess 174 is aligned with the center of the engagement recess 176. When the drive mechanism 130 is in a disengaged configuration, as shown in FIG. 6B, the center of the tapered engagement recess 174 may be misaligned (out of alignment) with the center of the engagement recess 176. When the drive mechanism 130 is in the disengaged configuration shown in FIG. 6B, the movable partition 102 may be manually moved along the track 114 without working against the resistance of motor 140.

Misalignment between the tapered engagement recess 174 and the engagement recess 176 may be limited (using the limit pin 182 and the mounting plate slot 184) such that the offset is less than the radius of the tapered engagement cone 180. Thus, when tapered engagement cone 180 is forced through the engagement recess 176 and into the tapered engagement recess 174 by the engagement device 170, the tapered engagement cone 180 will cause the motor mounting plate 138 to move relative to the support plate 134 until the engagement recess 176 is aligned with the tapered engagement recess 174, and the rotatable drive member 136 is engaged with the elongated, fixed drive member 132.

Upon retraction of the tapered engagement cone 180 from the tapered engagement recess 174 and the engagement recess 176 by the engagement device 170, in some embodiments, there may be no force remaining to hold rotatable drive member 136 in engagement with the elongated, fixed drive member 132. Thus, when the movable partition 102 is then manually pushed or pulled along the track 114 (after disengaging the engagement device 170), the resistance of the motor 140 may cause the motor mounting plate 138 to move relative to the support plate 134 until the rotatable drive member 136 is disengaged from the elongated, fixed drive member 132. In other embodiments, a biasing element may be used to bias the drive mechanism 130 in the disengaged configuration. For example, as shown in FIGS. 6A and 6B, a bias element 166, e.g., a spring, may be coupled between the motor mounting plate 138 and the support plate 134 and configured to pull or push the drive mechanism 130 out of engagement with the elongated, fixed drive member 132 upon releasing the engagement device 170 (FIG. 4). In other words, the bias element 166 may be configured to bias the drive mechanism 130 to the disengaged configuration. As shown in FIGS. 6A and 6B, the bias element 166 may be attached to the support plate 134 and to the motor mounting plate 138 to pull the motor mounting plate 138 into a disengaged position when engagement device 170 is disengaged. When the end of motor mounting plate 138 is pulled by the bias element 166, the motor mounting plate 138 may rotate about axis 142 and consequently disengage rotatable drive member 136 from the fixed drive member 132. Other embodiments may include a rotational spring (not shown) installed at or near axis 142 and configured to bias the drive mechanism 130 into a disengaged state, as will be evident to one of ordinary skill in the art.

In one embodiment, the engagement device 170 may include a push-type DC tubular solenoid available from Guardian Electric Manufacturing Company of Woodstock, Ill. Of course, it will be appreciated by those of ordinary skill in the art that other components may be used in place of the engagement device 170 to accomplish the same or a similar function.

It is noted that the engagement device 170, in some embodiments, may be a pneumatically or hydraulically actuated piston and cylinder or an electromechanical solenoid, for example, or any other means of pushing, pulling, or rotating the motor into or out of an engaged state. In further embodiments of the present invention, the engagement device 170 may be absent. In this case, the motor mounting plate 138 may be pivotally secured to the support plate 134 as described above and by the additional use of a bolt or some other fastener (not shown). When the user desires to disengage the drive mechanism 130 or rotatable drive member 136 from the fixed drive member 132, the user may simply release the bolt or other fastener, thereby allowing the drive mechanism 130 to be rotated out of an engaged configuration. Such embodiments might be desirable where automatic disengagement of the drive mechanism 130 from the fixed drive member 132 is unnecessary or undesirable.

Control of the movement of the movable partition 102, the engagement device 170, and/or the drive mechanism 130 may be accomplished, in some embodiments, by the use of sensors and controls. Referring again to FIG. 4 in conjunction with FIG. 1, the movable partition 102, when used as a fire door, for example, may include a switch or actuator 126, commonly referred to as "panic hardware." Actuation of the panic hardware 126 allows a person located on one side of the movable partition 102 to cause the door to be opened if it is closed, or to stop while it is closing, allowing egress through the barrier formed by the door as needed. Allowance of access upon actuation of the panic hardware 126 may occur by automatically powering off and disengaging the engagement device 170, which may release the engagement member 172 and drop tapered engagement cone 180, as described above.

Figure 8:
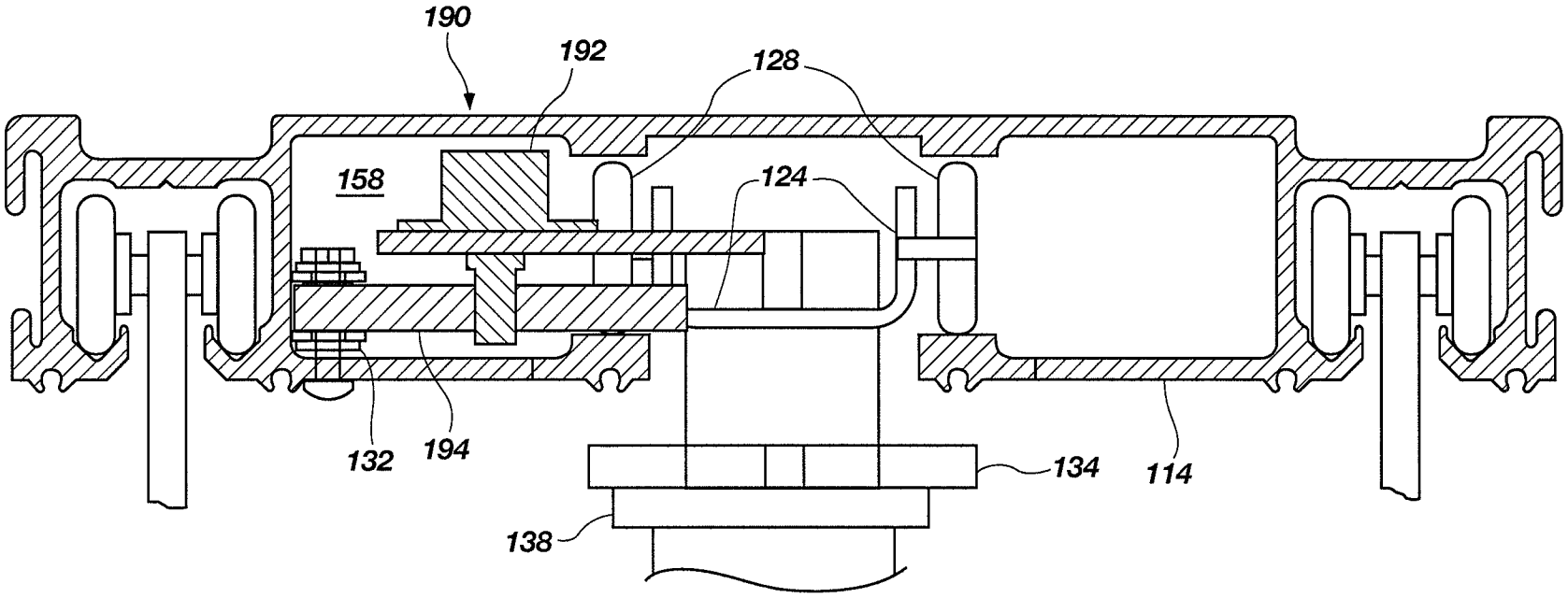
FIG. 8 is a partial cross-sectional view like those of FIGS. 2 and 5, but taken along section line 8-8 in FIG. 4, and illustrates components of the movable partition system used for determining the position of the lead post of the movable partition along a track.

Referring now to FIG. 8 in conjunction with FIG. 4, some embodiments of the present invention may additionally include a tracking device or system 190 for determining the position of at least a portion of the movable partition 102 along the track 114. By way of example and not of limitation, the tracking device or system 190 may be used for determining the position of the lead post 116 of the movable partition. In some embodiments, the tracking device or system 190 may be capable of tracking a position of the lead post 116 at all times. Determination of the position of the lead post 116 may be desirable so that the automatic movable partition system 100 may be able to properly control the engagement of the lead post 116 with the jamb or door post 118, the closing of movable partition 102, and/or the driving of movable partition 102 to a desired position. This control may be important after the door has been manually moved by maintenance personnel or a firefighter, for example. The tracking device or system 190 may include an encoder 192 attached to a counter sprocket 194, which may be engaged with the elongated, fixed drive member 132. The encoder 192 may optically or magnetically track the number of revolutions or partial revolutions of the counter sprocket 194. It can be determined how many revolutions the counter sprocket 194 will make per unit length of the fixed drive member 132 (e.g., inches or feet), and by determining how many revolutions the counter sprocket 194 has made, it can be determined how far the counter sprocket 194 has traveled along the fixed drive member 132. The encoder 192 may include or be coupled with a microprocessor (not shown) that calculates the position of the movable partition 102. In some embodiments, the counter sprocket 194 may be engaged the fixed drive member 132 at all times. The tracking device or system 190 may be coupled to and carried by the support trolley 124 and/or to the support plate 134 so that the tracking device or system 190 stays engaged with fixed drive member 132, even when the drive mechanism 130 is disengaged with the track 132.

In one embodiment, the encoder 192 may include an optical encoder available from Avago Technologies of San Jose, Calif. The encoder 192 may use an LED that emits light onto a codewheel surface, projecting an image back on a photodetector, causing the output to change as the counter sprocket 194 rotates. However, it will be appreciated by those of ordinary skill in the art that other components may be used for the encoder 192. Additionally, other tracking systems or mechanisms may be used to determine the position of movable partition 102 along the track 114.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition system comprising:

a movable partition comprising a plurality of hingedly connected folding panels coupled to, and movable along, an overhead track so as to partition a space within a building;

a motor carried by the movable partition;

at least one elongated, fixed drive member extending along the track;

a rotatable drive member coupled to a drive shaft of the motor, the rotatable drive member movable relative to the elongated, fixed drive member between an engaged position in which the rotatable drive member is engaged with the elongated, fixed drive member and a disengaged position in which the rotatable drive member is disengaged from the elongated, fixed drive member, rotation of the rotatable drive member while the rotatable drive member is in the engaged position causing the movable partition to move along the track;

a support plate coupled to, and movable along, the track;

a motor mounting plate rotatably coupled to the support plate on a substantially vertical axis relative to the movable partition, the motor mounted to the motor mounting plate;

an actuator accessible to a person located on a side of the movable partition when the movable partition is in an at least partially closed position; and an engagement device configured to maintain the rotatable drive member in the engaged position during automatic movement of the movable partition along the track, the engagement device comprising:

an engagement recess extending through the support plate;

a tapered engagement recess extending at least partially through the motor mounting plate; and a tapered engagement cone configured to extend through the engagement recess in the support plate and to extend at least partially through the tapered engagement recess in the motor mounting plate and coaxially align the tapered engagement recess in the motor mounting plate with the engagement recess in the support plate to maintain the engagement device in the engaged position;

wherein actuation of the actuator causes the engagement device to release the rotatable drive member from the engaged position to the disengaged position by moving the motor mounting plate relative to the support plate, causing the rotatable drive member to move between the engaged position and the disengaged position, thereby enabling manual movement of the movable partition without working against the resistance of the motor.

2. The movable partition system of claim 1, wherein the engagement device comprises an electromechanical solenoid.

3. The movable partition system of claim 1, wherein the engagement device comprises a solenoid configured to drive the tapered engagement cone against the tapered engagement recess of the motor mounting plate.

4. The movable partition system of claim 3, wherein the motor mounting plate is positioned adjacent to the support plate and oriented at least substantially parallel to the support plate.

5. The movable partition system of claim 1, further comprising a biasing member comprising at least one spring member biasing the rotatable drive member toward the disengaged position.

6. The movable partition system of claim 1, wherein the rotatable drive member comprises at least one of a sprocket, a gear, or a pinion and the elongated, fixed drive member comprises at least one of a chain, a belt, or a rack having features complementary to features of the rotatable drive member.

7. The movable partition system of claim 1, further comprising a device configured to determine a position of at least a portion of the movable partition relative to the track.

8. The movable partition system of claim 7, wherein the device configured to determine the position of the at least a portion of the movable partition relative to the track comprises an encoder device including at least one component engaged with the elongated, fixed drive member.

9. The movable partition system of claim 1, wherein resistance of the motor causes the rotatable drive member to move from the engaged position to the disengaged position in response to manual movement of the movable partition along the track when the engagement device is disengaged.

10. The movable partition system of claim 9, wherein the rotatable drive member is not biased to the disengaged position.

11. The movable partition system of claim 1, wherein movement of the motor mounting plate causes the motor and the rotatable drive member to move laterally with respect to the movable partition.

12. The movable partition system of claim 1, wherein the tapered engagement cone is configured to retract at least partially from the tapered engagement recess in the motor mounting plate and to retract at least partially from the engagement recess in the support plate to release the engagement device from the engaged position to the disengaged position.

13. The movable partition system of claim 12, wherein misalignment between the engagement recess in the support plate and the tapered engagement recess in the motor mounting plate when the tapered engagement cone is in the disengaged position is limited such that the axial offset between the tapered engagement recess in the motor mounting plate and the engagement recess in the support plate is less than a radius of the tapered engagement cone.

* * * * *